United States Patent [19]

Hodge

[11] 3,994,415

[45] Nov. 30, 1976

[54] TRASH CONTAINER LID SYSTEM

[76] Inventor: Allan M. Hodge, 5852 Lomond Drive, San Diego, Calif. 92120

[22] Filed: Nov. 21, 1975

[21] Appl. No.: 634,049

Related U.S. Application Data

[63] Continuation of Ser. No. 494,549, Aug. 5, 1974, abandoned.

[52] U.S. Cl. ..... 220/331; 220/1 T; 220/318

[51] Int. Cl.² ..... B65D 43/16

[58] Field of Search ..... 220/1 T, 318, 331

[56] References Cited

UNITED STATES PATENTS

| | | | |
|---|---|---|---|
| 2,292,092 | 8/1942 | Shankweiler | 220/331 |
| 2,338,477 | 1/1944 | Wolters | 220/331 |
| 2,569,254 | 9/1951 | Page | 220/331 |
| 2,682,351 | 6/1954 | Durano | 220/331 |
| 3,487,887 | 1/1970 | Pensa | 220/331 |

*Primary Examiner*—Ro E. Hart

[57] ABSTRACT

A trash container lid system for placement on top of large industrial trash bins of the type utilized in hotels, apartment houses, etc., in which a lid section counterweighted in the rear portion thereof is slidably and rotatably coupled to a trash bin via a roller in the mid portion of the lid section in a track on the top of the side edges of the trash bin and a roller in the rearward bottom portion of the lid section trapped in an arcuate downwardly extending track so that by sliding the lid to the rear the back track automatically raises the front of the lid section for the deposit of trash therein and upon inverting the trash bin, the lid section automatically falls completely open.

2 Claims, 4 Drawing Figures

TRASH CONTAINER LID SYSTEM

RELATED APPLICATIONS

This application is a continuation of an application for U.S. Letters Pat. filed by ALLAN M. HODGE on Aug. 5, 1974, Ser. No. 494,549 now abandoned for TRASH CONTAINER LID SYSTEM. An application for U.S. Letters Patent has been filed by ALLAN M. HODGE on Feb. 8, 1973, Ser. No. 330,569, for TRASH CONTAINER LID SYSTEM, now issued at U.S. Pat. No. 3,836,036 on Sept. 17, 1974.

BRIEF DESCRIPTION OF THE INVENTION

The present invention relates to a trash container lid system and more particularly to a trash container lid system having a stabilized partially open position.

According to the invention, a trash container lid system is provided which is slidably and rotatably coupled to a trash bin via a first pair of rollers rotatably carried by the lid section in its lower mid portion riding on roller tracks on the top of the side edges of the trash container and a second pair of rollers each roller being trapped in an arcuate downwardly extending roller track extending from the top of the back portion of the trash bin. Hence, when the lid is pushed toward the rear of the trash bin and away from the front of the trash bin, it will automatically tilt until the trapped rollers each reach the end of the in arcuate tracks. In this position, a counterweight located in the rear portion of the lid section holds the lid in open position until after the trash has been dumped and the lid pulled toward the front. Upon dumping the trash bin in the normal manner when forks on the trash truck lift the entire assembly over the cab of the truck and invert the entire trash bin, the lid will automatically fall open in a vertical position since the top centrally located rollers are not trapped in a roller track. This, of course, allows a complete emptying of the trash bin when desired.

An object of the present invention is the provision of an improved trash container lid system.

Another object of the invention is the provision of a trash container lid assembly having a stabilized partially opened position.

A further object of the invention is the provision of an improved trash container lid system utilizing a counterweight.

Yet another object of the invention is the provision of a trash container lid assembly requiring a minimum of force in opening and closing.

Other objects and many of the attendant advantages of the present invention will be readily appreciated as the same becomes better understood by reference to the following detailed description when considered in connection with the accompanying drawings in which like reference numerals designate like parts throughout the Figures thereof and wherein.

DETAILED DESCRIPTION OF THE DRAWING

Figure 1:
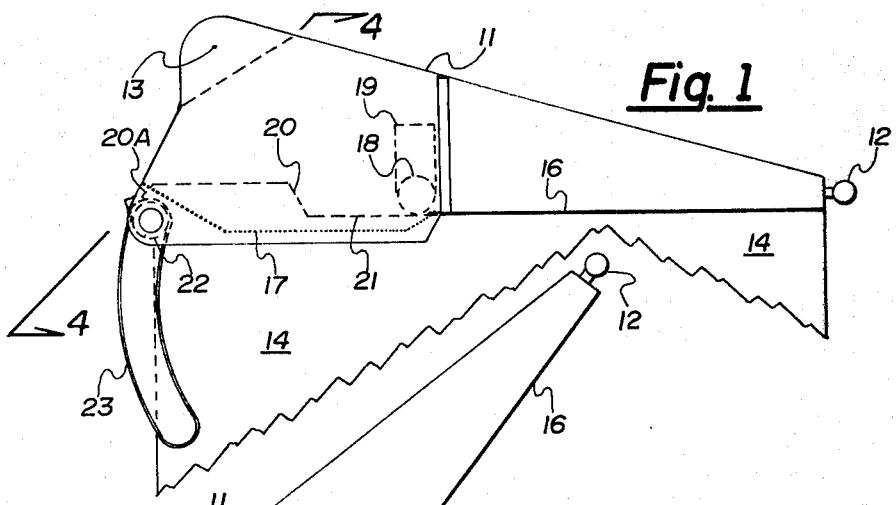
FIG. 1 is a side elevational view of a preferred embodiment of the present invention in a closed position.
Figure 2:
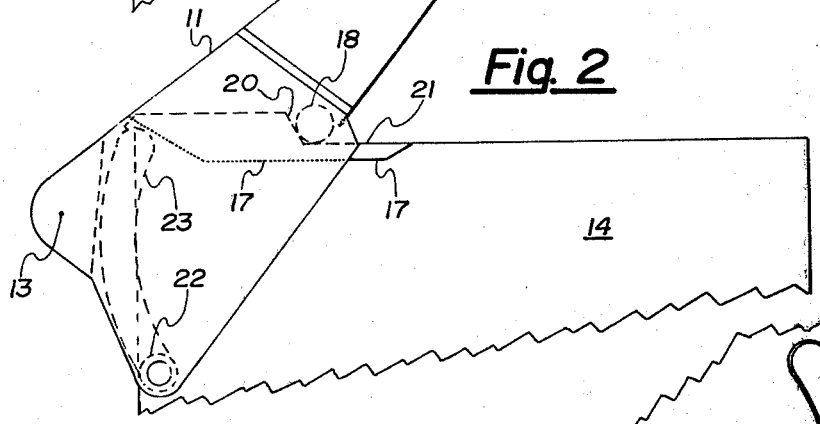
FIG. 2 is a side elevation of the embodiment of FIG. 1 in an open position.
Figure 3:
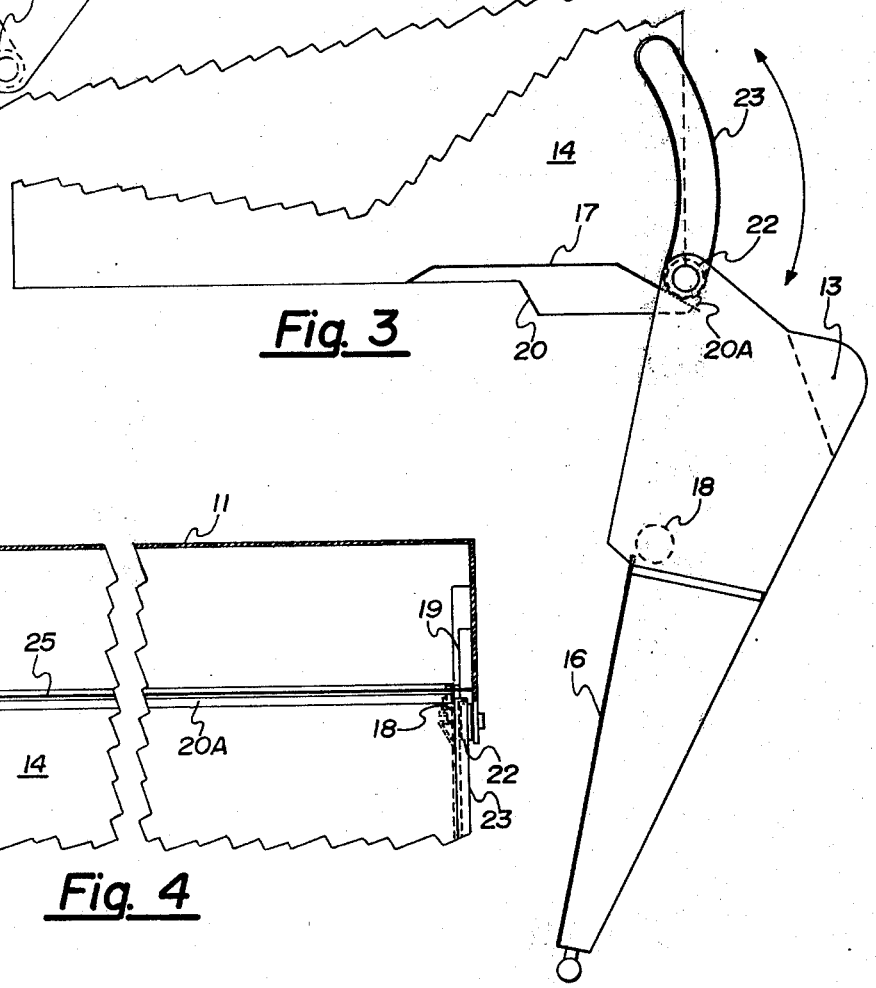
FIG. 3 is a side elevational view of the present invention inverted for dumping.

Referring to FIGS. 1, 2 and 3, a lid assembly 11 has a front handle 12 and a back counterweight section 13. Lid section 11 is carried by trash bin 14 with front seal 16 and a rearward lip type of seal 17 such as that disclosed in the above referenced U.S. Pat. No. 3,836,036. Lid section 11 has a pair of centrally located rollers 18 rotatably carried by mounting brackets 19 which are fixedly attached to lid section 11. Rollers 18 are carried by horizontal rollers tracks 21. Rear roller 22 is rotatably carried by lid section 11 and are trapped within arcuate downwardly extending roller tracks 23. Horizontal roller tracks 21 terminate in a raised portion 20 of the rearward section of the top edge of trash bin 14.

Figure 4:
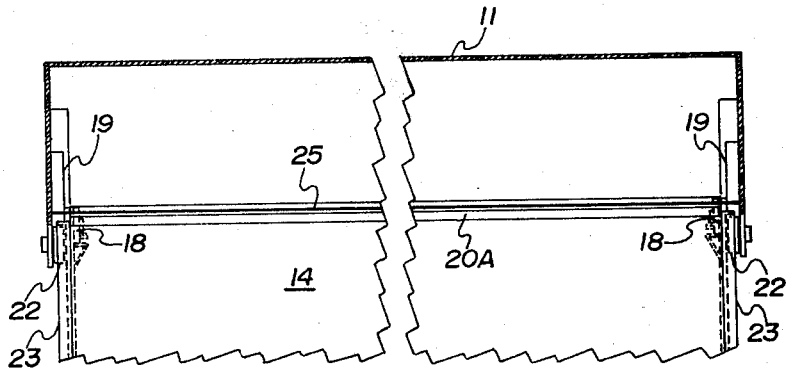
FIG. 4 is a back elevational view of the embodiment of FIG. 1 with the lid portion sectioned.

Referring to FIG. 4, bin 14 is shown disposed beneath lid section 11 with rear rollers 22 trapped within downwardly extending arcuate roller tracks 23 which are fixedly attached at the sides of bin 14. A seal is shown at 25 on angle bracket 20A coupled to raised portion 20 (FIGS. 1, 2 and 3).

OPERATION

Referring back to FIG. 1, it can be seen that in the closed position, lid section 11 has a front portion seal 16 resting firmly on the top edge of the trash bin 14. A lip seal 17 completes the seal across the entire surface of the side of bin 14. When the handle 12 of lid section 11 is raised, back roller 22 begins its descent down arcuate track 23 and mid section roller 18 begins rolling along track 21 toward the rear. Roller 18 is kept on the surface of track 21 due to the fact that it acts as a pivot or fulcrum point as the lid section drops guided by track 23 and roller 22. The counterweight section 13 renders the lifting force required on handle 12 very minimal. When roller 18 reaches raised portion 20 of the top edge of the trash bin 14, the rearward roller 22 simultaneously reaches the end of closed roller track 23 and the lid is then in the position shown in FIG. 2. At this point, counterweight section 13 is enough to balance the lid section 11 in the position shown. When it is desired to re-close the lid section 11, handle 12 is merely pulled in a downward and/or forward direction, again requiring very little force and the opposite action takes place. Here a forward stop for roller 18 is not essential because the front portion of lid section 11 having seal 16 rests on the top edges of trash bin 14.

When the dumping of trash bin 14 is required, the entire unit is inverted via conventional dump trucks and rollers 18 will leave track 21 and the entire lid section will hang vertically below trash bin 14, thereby allowing all of the trash to be dumped. In this position rollers 22 reach the end of closed track 23 which secure lid section 11 to trash bin 14, and the bottom rear corners of lid section 11 contact angle 20A of bin 14.

It should be understood, of course, that the foregoing disclosure relates to only a preferred embodiment of the invention and that it is intended to cover all changes and modifications of the example of the invention herein chosen, for the purposes of the disclosure, which do not constitute departures from the spirit and scope of the invention.

The invention claimed is:

1. A trash lid container system comprising:

a trash bin having a top edge;

a lid having a bottom edge dimensioned for cooperation with the top edge of the trash bin;

a pair of mounting brackets attached to and depending from the sides of said lid substantially midway between the front and back ends of said sides;

first and second rollers rotatably carried by said mounting brackets attached to said lid;

relatively short horizontal first and second roller tracks on the top edge of opposite sides of said trash bin terminating in a raised stop portion and rotatably carrying said first and second rollers, respectively;

a pair of downwardly extending arcuate roller tracks fixedly attached to the back portion of said trash bin; and third and fourth rollers rotatably carried by a back portion of said lid said third and fourth rollers being trapped within said pair of downwardly extending arcuate roller tracks, respectively, said first and second rollers forming a slidable pivot for said lid section to pivot open as it moves rearwardly, when said first and second rollers engage said raised stop portions of said first and second roller tracks.

2. The trash lid container system of claim 1 wherein said lid includes a counterweight adjacent to the rear of said lid operable for holding said lid in a partially open position.

* * * * *

Disclaimer 3,994,415.—*Allan M. Hodge*, San Diego, Calif. TRASH CONTAINER LID SYSTEM. Patent dated Nov. 30, 1976. Disclaimer filed Apr. 24, 1978, by the inventor.

The term subsequent to Dec. 13, 1994 has been disclaimed.

[*Official Gazette June 27, 1978.*]

Erratum 3,994,415.—*Allan M. Hodge*, San Diego, Calif. TRASH CONTAINER LID SYSTEM. In the notice of Disclaimers appearing on page 29 in the Official Gazette of June 27, 1978, the term of said patent was erroneously disclaimed and should be corrected to read as follows: The term of this patent subsequent to Sept. 17, 1991, has been disclaimed.

[*Official Gazette October 24, 1978.*]